US005383842A

United States Patent [19]

Bertini

[11] Patent Number: 5,383,842

[45] Date of Patent: Jan. 24, 1995

[54] APPARATUS FOR ENHANCING VENOUS CIRCULATION AND MASSAGE

[76] Inventor: Millo Bertini, 679 Garden St., Trumbull, Conn. 06611

[21] Appl. No.: 951,108

[22] Filed: Sep. 25, 1992

Related U.S. Application Data

[63] Continuation-in-part of Ser. No. 835,403, Feb. 14, 1992, Pat. No. 5,245,990.

[51] Int. Cl.[6] ..... A61H 7/00

[52] U.S. Cl. ..... 601/151; 601/152

[58] Field of Search ..... 128/24 R, 38–40, 128/64

[56] References Cited

U.S. PATENT DOCUMENTS

| | | | |
|---|---|---|---|
| 1,253,232 | 1/1918 | Guilford | 128/24 R |
| 2,528,843 | 11/1950 | Poor | 128/24 R |
| 2,533,504 | 12/1950 | Poor | 128/24 R |
| 2,674,231 | 4/1954 | Erickson | 128/24 R |
| 2,781,041 | 2/1957 | Weinberg | 128/24 R |
| 3,403,673 | 10/1968 | MacLeod | 128/64 X |
| 3,811,431 | 5/1974 | Apstein | 128/64 |
| 3,866,604 | 2/2975 | Curless et al. | 128/64 |
| 4,013,069 | 3/1977 | Hasty | 128/24 R |
| 4,030,488 | 6/1977 | Hasty | 128/24 R |
| 4,235,449 | 3/1981 | Arkans et al. | 128/24 R |
| 4,311,135 | 1/1982 | Brueckner et al. | 128/24 R |
| 4,338,923 | 7/1982 | Gelfer et al. | 128/24 R |
| 4,370,975 | 1/1983 | Wright | 128/64 |
| 4,374,518 | 2/1983 | Villanueva | 128/64 |
| 4,738,249 | 4/1988 | Linman et al. | 128/64 X |
| 4,747,398 | 5/1988 | Wright | 128/64 |
| 5,052,377 | 10/1991 | Frajdenrajch | 128/64 |
| 5,179,941 | 1/1993 | Siemssen et al. | 128/64 X |
| 5,245,990 | 9/1993 | Bertinin | 128/64 |

FOREIGN PATENT DOCUMENTS

| | | | |
|---|---|---|---|
| 516272 | 12/1939 | United Kingdom | 128/64 |

*Primary Examiner*—Max Hindenberg
*Assistant Examiner*—Brian E. Hanlon
*Attorney, Agent, or Firm*—Arthur T. Fattibene; Paul A. Fattibene

[57] ABSTRACT

A method and apparatus for enhancing venous circulation in persons having venous insufficiencies and/or for effecting muscular massage for preventing muscle atrophy. This is attained by a wrap or sleeve adapted to circumscribe the portion of the body to be treated which includes an inflatable flexible tubing or tube which is inflated and deflated for producing a smooth, progressive massaging force on the body portion being treated. In operation, a fluid pressure inflates the respective tubes in a progressive manner whereby a massaging force is progressively applied against the body part as the tubes are sequentially inflated and which massaging force is relieved when the tubes are deflated. A control circuit is provided to control the inflation and deflation of the flexible tubing to effect a repetitive cycle in a predetermined time sequence. In one form of the invention, a wrap or sleeve circumscribes two body parts to be treated, each wrap or sleeve including a plurality of inflatable flexible tubes which are progressively inflated in an alternating sequence. Associated with the respective wrap or sleeve is a control manifold with a reciprocating valving member operating to effect a progressive inflation of the respective tubes in one sleeve as all the inflatable tubes in the other sleeve are simultaneously deflated, and the cycle repeated.

7 Claims, 7 Drawing Sheets

APPARATUS FOR ENHANCING VENOUS CIRCULATION AND MASSAGE

RELATED APPLICATION

This is a continuation in part application of my copending application, Ser. No. 07/835,403 filed Feb. 14, 1992 now U.S. Pat. No. 5,245,990 for A Method And Apparatus For Enhancing Venous Circulation And Massage.

This invention is directed to a method and an apparatus for improving or enhancing venous circulation in persons having venous insufficiencies and for providing muscular massage to prevent muscle atrophy.

PRIOR ART

Heretofore, various types of appliances have been conceived to facilitate rehabilitations of injured body parts by promoting venous blood flow. A number of such therapeutic devices are known, as evidenced by U.S. Pat. Nos. 2,168,611; 2,531,074; 3,824,992; 4,370,975; 3,094,116; 4,702,232; 4,805,601; U.S. Pat. Nos. Re. 32,939 and 32,940. Other therapeutic appliances are evidenced by U.S. Pat. Nos. 3,888,242 and 4,573,453, which relate primarily to massaging various body appendages. U.S. Pat. No. 4,421,109 is directed to an apparatus for simulating gravitational forces on the body and U.S. Pat. No. 3,908,642 is a means for applying forced air in a body cast to alleviate the discomfort of a body part confined to a cast for a considerable period of time. For the most part, the prior known devices as noted are relatively complex in structure and costly to fabricate.

OBJECTS

An object of this invention is to provide a relatively simple and inexpensive appliance for enhancing venous circulation and/or for massage.

Another object is to provide an appliance and method for subjecting the body part to be treated to a progressively applied positive pressure in a predetermined timed cyclical sequence that enhances venous circulation with a comforting massage effect.

Another object of this invention is to provide a method and apparatus for applying a progressive wave-like massaging effect on a body part to be treated by progressively inflating an inflatable member circumscribing the body part to impart a positive pressure thereon and thereafter deflating the inflatable member and repeating the cycle in a timed sequence.

Another object of this invention is to provide a pair of wraps or sleeves for encircling at least one or two body parts to be treated.

Another object of the invention is to provide a massaging apparatus and method for alternately massaging at least two body parts where one body part is being progressively massaged while the applied progressive massaging force previously applied to the other body part is simultaneously relieved; and which cycle is alternately repeated.

SUMMARY OF THE INVENTION

The foregoing objects and other features and advantages are attained by a wrap or sleeve which is adapted to circumscribe the body part to be treated and which has connected thereto an inflatable tube. In one form of the invention, the inflatable tube includes a plurality of independent tubes adapted to circumscribe a body part at predetermined spaced intervals. Each of the independent tubes are connected in communication with a fluid supply manifold. Reciprocally mounted within the supply manifold is a slidable piston to sequentially valve the inlet of the independent tubes. The arrangement is such that the respective tubes are sequentially inflated to impart a pressure on the body part with a wave-like massaging rhythm. The piston is connected to a motor or spring for effecting the return stroke of the piston. Fluid pressure is applied to the supply manifold through a solenoid valve controlled by a suitable timer. The arrangement is such that fluid pressure is supplied to the manifold when the solenoid valve is actuated to effect the displacement of the piston. The displacement of the piston effects a sequential opening of the inlet to each of the independent inflative tubes to effect the successive inflation thereof to impart a wave-like massage effect on the body part. At the end of the piston stroke, the solenoid valve is shifted to an exhaust position whereby the inflatable tubes are simultaneously deflated, whereupon the piston is returned to its initial position, either under a spring action or by a drive motor; and the cycle repeated.

In another form of the invention, the sleeve is defined by a wrap having connected thereto a continuous inflatable tube disposed in a zigzag pattern. A cord is threaded through the inflatable tube to insure against total closing of the tube at the reverse bends thereof. In this form of the invention, when the solenoid valve is actuated, fluid pressure will progressively inflate the successive bends of the zigzag tube to impart a continuous wave-like pressure to the body part. Upon the complete inflation of the tube, the solenoid valve is shifted to exhaust the fluid pressure within the tube to effect the deflation thereof, and the cycle is repeated in a timed sequence.

In another form of the invention, a pair of wraps or sleeves are arranged to encircle a pair of body parts, each wrap or sleeve including a plurality of inflatable tubes operatively connected to a fluid supply manifold.

The fluid supply manifold includes two independent chambers having a slidable piston disposed in each. Each chamber is operatively connected to one of the wraps or sleeves for controlling the inflation and deflation of the plurality of inflatable tubes in the respective wraps or sleeves. The respective pistons are interconnected so that as one chamber is operating to effect inflation of one of the wraps or sleeves for imparting a massaging action on one of the body parts, the other sleeve is being deflated to release the massaging force applied to the other body part; and in which the cycle is repeated so as to effect an alternating massaging force on the respective body part or limbs.

FEATURES

A feature of this invention resides in the provision of a shell or wrap arrange to circumscribe a portion of the body and having connected thereto an inflatable tube which is progressively inflated to impart a wave-like massaging pressure on the body part.

Another feature resides in the provision of a plurality of inflatable tubes disposed in a shell circumscribing a body part wherein the respective tubes are sequentially inflated to provide a wave-like massaging pressure on the body part.

Another feature resides in the provisions of a body wrap having connected thereto a continuous inflatable tube disposed in a zigzag pattern in which the respective sections of the inflatable tube are sequentially inflated to provide the wave-like massaging pressure on the body part.

Another feature resides in the provision of a cord threaded through the inflatable tube when disposed in a zigzag pattern to prohibit total closing of the tube at the reverse bends thereof.

Another feature resides in the provision of a pair of wraps or sleeves, each operatively connected to a manifold which are alternately actuated for alternating the massaging force applied to a pair of body parts.

Another feature resides in the provision of a pair of manifolds for applying a fluid pressure to an associated sleeve or wrap in which the respective pistons valving the flow of fluid to the respective sleeves or wrap are interconnected.

Other features and advantages will be rendered apparent in view of the following detail described and drawings in which.

DETAIL DESCRIPTION

Figure 1:
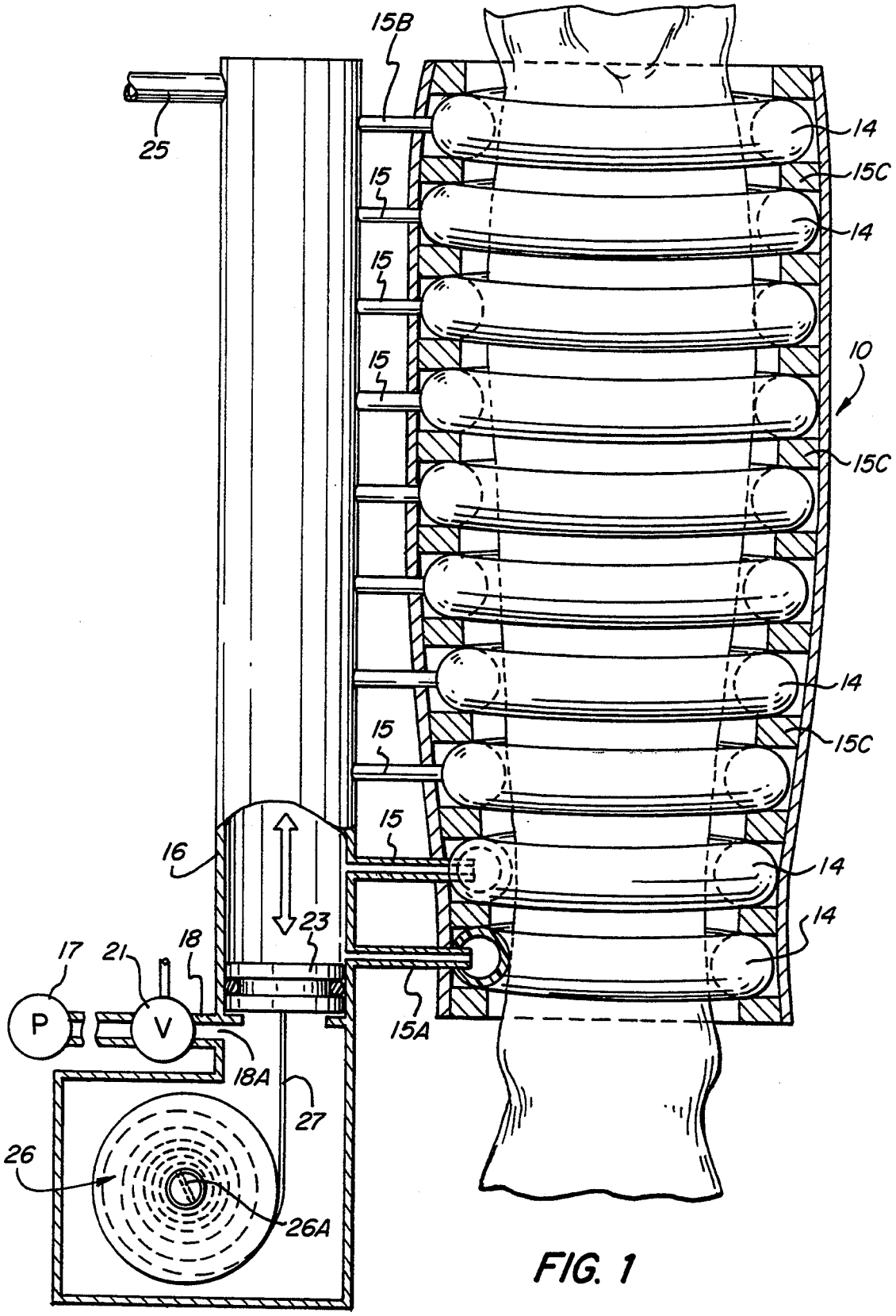
FIG. 1 is a vertical sectional view of a pressure applying device embodying the invention.
Figure 2:
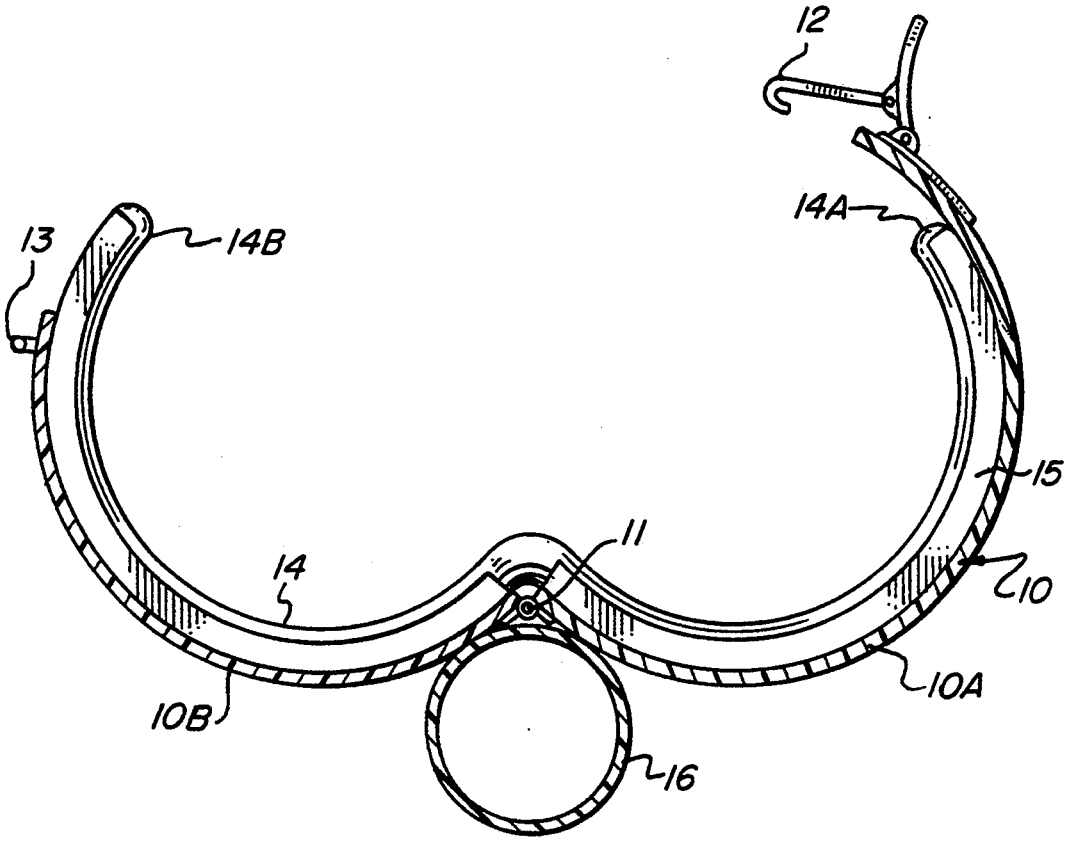
FIG. 2 is a cross-sectional view of the device of FIG. 1 illustrated in the opened position thereof.
Figure 3:
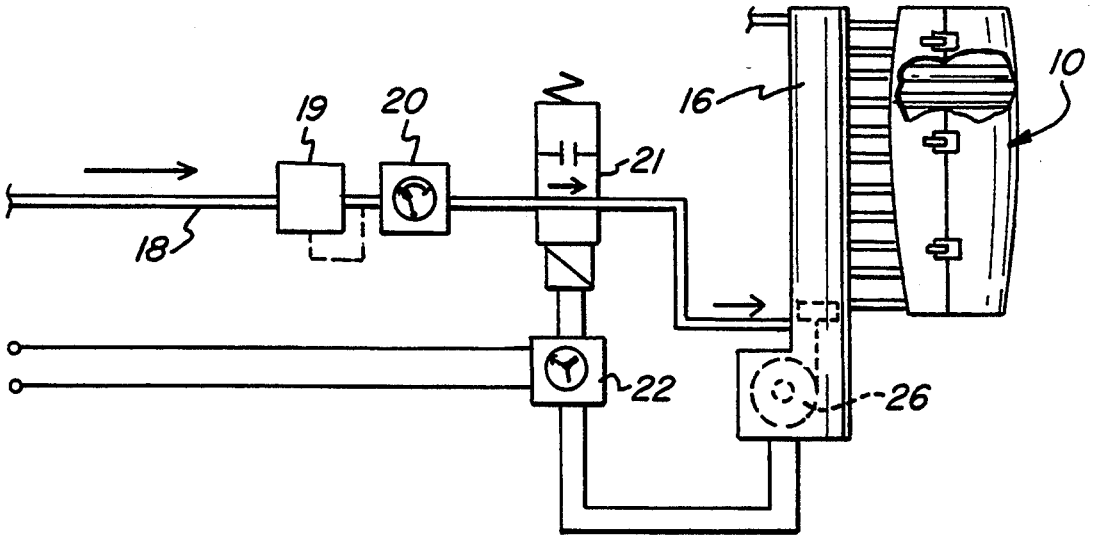
FIG. 3 is a diagrammatic showing of the control circuit.

Referring to the drawings, there is illustrated in FIGS. 1 to 3 an embodiment of the invention. As shown, the invention comprises a shell or wrap 10 which is adapted to encircle a body portion or part to be treated. In the illustrated embodiment, the shell 10 is adapted to encircle a leg. To facilitate applying the shell 10 to the body part, e.g. a leg, the shell is formed of two half sections 10A, 10B connected by a suitable hinge 11 whereby the respective sections can be readily applied to and removed from the body part. Preferably, the respective shell sections 10A and 10B are formed of a suitable rigid material, e.g. plastic or light weight metal. A suitable latch 12 and complementary catch is provided for latching the respective shell section onto the body part when a massaging pressure is to be applied to the body part. Secured to the respective sections 10A and 10B are a plurality of inflatable tubes 14. As best seen in FIG. 3, the respective tubes are longitudinally spaced along the length of the shell; with a suitable spacer 15 disposed between adjacent pairs of inflatable tubes. As best seen in FIG. 2, each tube 14 comprises an elongated inflatable tube which is closed at its ends 14A, 14B. The tube 14 is formed of readily flexible material so that when the shell is closed about the body part, the tube 14 can readily encircle the body part to be treated. The respective tubes are suitably connected to the respective shell sections 10A, 10B by any suitable means. While the shell 10 is illustrated as being generally cylindrical, it will be understood that the shell 10 may be formed to substantially conform to the shape of the body part being treated. The shell is also proportioned so that when the tubes 14 are inflated as hereinafter described, a pressure is applied to the adjacent body part.

In the illustrated embodiment and as best seen in FIG. 1, each inflatable tube 14 is provided with a nipple 15 through which a fluid pressure is permitted to flow to inflate and deflate the tube 14. Connected in communication with each of the nipples is a supply manifold 16. The supply manifold 16, in turn, is connected to a source of fluid pressure, e.g. an air compressor 17 or other suitable source of an actuating fluid by means of a connecting conduit 18. Disposed in the conduit 18 is a suitable regulator 19, pressure gauge 20 and a solenoid valve 21, as best seen in FIG. 3. The solenoid valve 21 is a suitable electrically controlled valve having a first position for directing fluid pressure to tubes 14 when actuated to inflate the tubes and a second position to effect deflation of the tubes 14. The actuation of the solenoid valve is effected by a suitable timer 22 connected to a circuit therewith as shown in FIG. 3 to effect actuation of the solenoid valve between its inflating and deflating positions in a controlled timed sequence.

Slidably disposed within the supply manifold 16 is a reciprocating piston 23. In the normal inoperative position, the piston 23 is disposed between the pressure supply inlet 18A to the manifold 16 and the first nipple or fluid inlet 15 of the lowermost tub 14. The arrangement is such that when the solenoid valve 21 is actuated to its inflating position, the fluid or air pressure is directed into the manifold through inlet 18A causing the piston to be displaced upwardly as seen in FIG. 1. Thus, as the piston passes each of the nipples 15, the associated tube will be inflated causing the inflated tube to exert a massaging pressure on the adjacent body part. It will be noted that each tube 15 is successively inflated as the piston is displaced from its lowermost position to its highest most position as viewed in FIG. 1 to impart a soothing massaging effect on the adjacent body part.

The upper end of the manifold is vented by a suitable vent 25 to the atmosphere. An alternate means for venting the manifold can be achieved by simply providing the manifold with an opening to atmosphere at the upper end thereof.

As the piston reaches or valves the last or uppermost nipple 15B, the timer will cause the solenoid valve 21 to shift to a deflating position whereby the fluid pressure in the manifold and connecting inflatable tubes 15 is exhausted to atmosphere through the solenoid valve.

To return the piston 23 to its initial position as shown in FIG. 1 after reaching the end of its travel, a suitable return means is provided. In the illustrated embodiment, an intermittent motor 26 is provided. It will be understood that the motor is connected in circuit with the timer 22 so as to time its actuation with that of the solenoid valve. In the illustrated embodiment, the motor actuates a spindle 26A, about which a cord 27 is wound, the end of which is connected to the piston 23. The spindle 26A is free to rotate in one direction and is motor driven in the other or reverse direction. Thus, when the piston 23 is displaced under fluid pressure, the cord 27 is free to unwind from the spindle 26A. When the piston 23 reaches its high point and the solenoid 21 is shifted to the deflation position, the motor 26 is activated to drive the spindle 26A in the opposite direction causing the cord 27 to be rewound thereon to pull the piston 23 back to its initial inoperative position. Upon return of the piston 23, the cycle is repeated.

In lieu of a motor, the piston 23 may be connected to a spring means for effecting the return thereof.

From the foregoing, it will be apparent that in operation, the successive inflation of the respective tubes 14 by the action of the piston valving the respective nipples or inlets 15 thereto causes the respective tubes 14 to be successively and progressively inflated in a timed sequence which will impart a pressure on the adjacent body part in a wave-like action. This wave-like action or pressure enhances venous circulation and/or effects a soothing muscular massage on the body part to prevent muscle atrophy.

Figure 5:
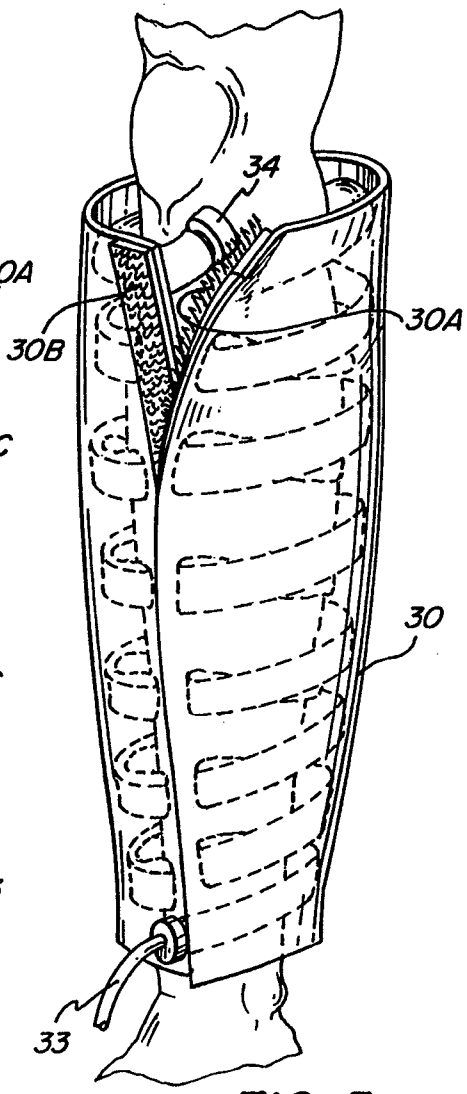
FIG. 5 is a perspective view of the embodiment of FIG. 4 illustrated in an operative position.
Figure 4:
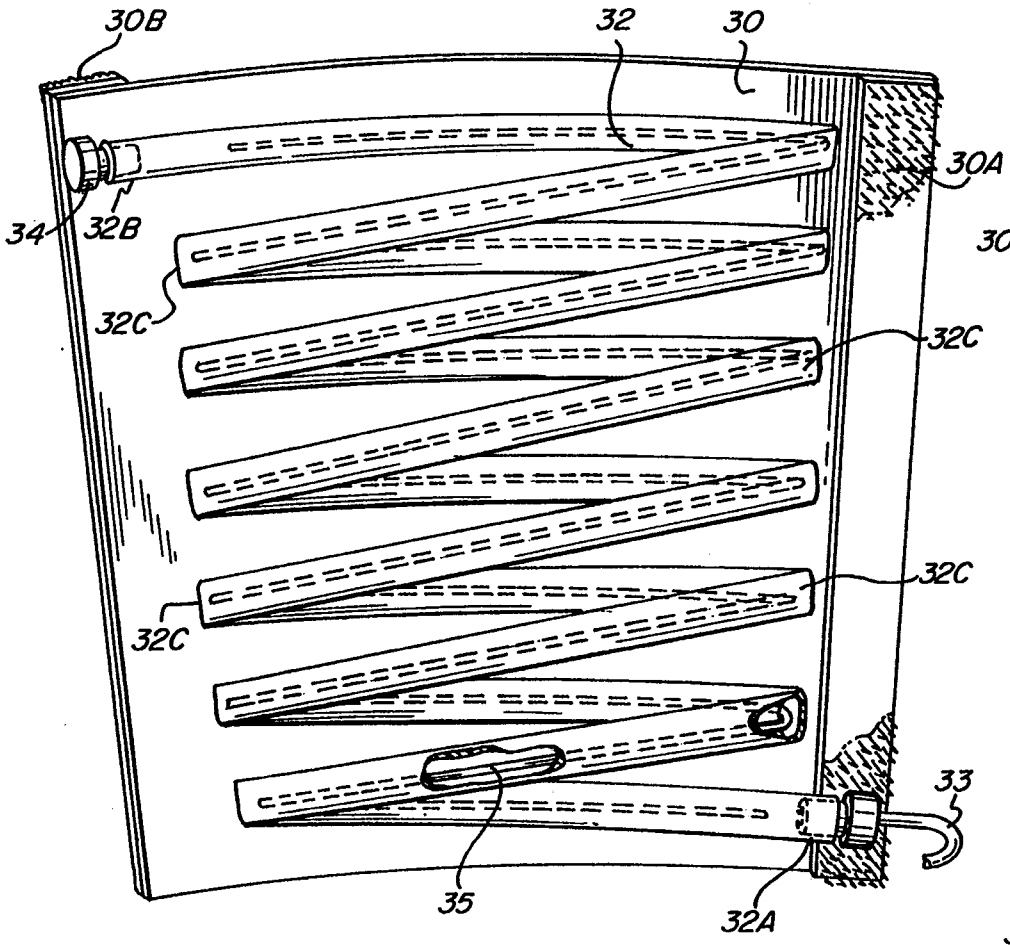
FIG. 4 is a plan view of a modified form of the invention.
Figure 6:
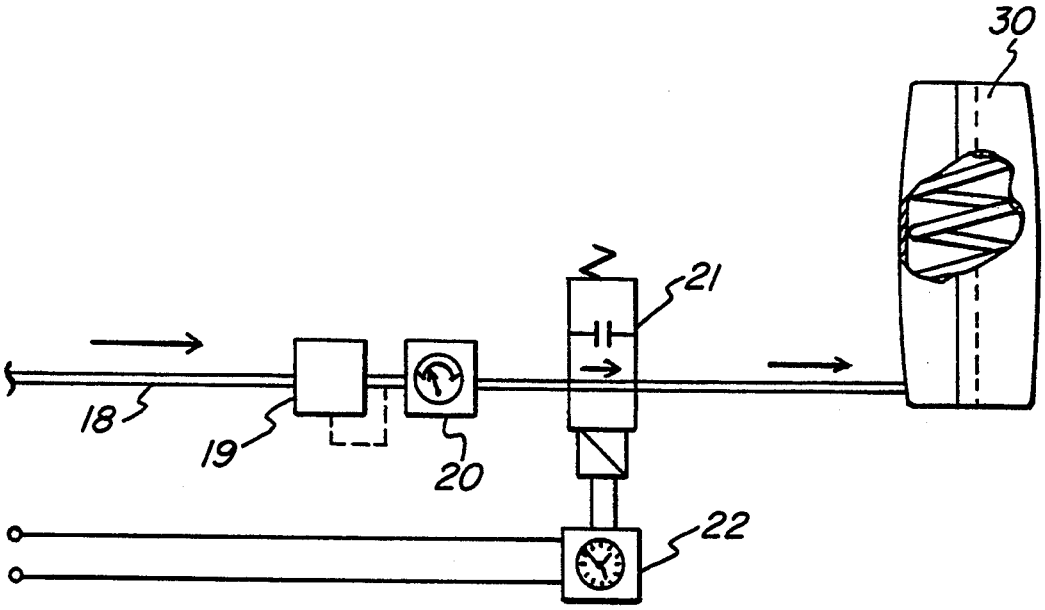
FIG. 6 is a diagrammatic showing of a control for use with the illustrative massaging appliance of FIG. 4.

FIGS. 4 and 5 illustrate another embodiment of the invention. In this form of the invention, the shell takes the form of a flat flexible wrap 30, which may be formed of a suitable fabric material. The opposed longitudinal edges of the wrap 30 may be provided with a strip 30A, 30B of a complementary "Velcro" type material. Such strips 30A, 30B comprise a fastening means whereby the wrap 30 when placed about the body part, e.g., a leg, and securely fastened by the interlocking or overlapping of the "Velcro" strips 30A, 30B, as best seen in FIG. 5.

Connected to the inner surface of the wrap 30 is a continuous inflatable tube 32 which is secured thereto in a zigzag pattern, as best seen in FIG. 4. The lower end 32A is connected to a supply conduit 33, which in turn, is connected to a source of fluid supply, e.g. an air compressor. The other end 32B of the tube 32 is suitably sealed, e.g. by a plug 34. Or, in the alternative, the end 32B of the tube can be welded or fusion sealed closed. It will be understood that the supply conduit 33 is connected to a solenoid valve 21 and an associated pressure regulator and pressure gauge, similar as described and shown in FIG. 3. Also connected in circuit with the solenoid valve is a timer 22, as hereinbefore described.

Because the tube 32 is normally flattened in its deflated state, causing the return bends 32C to be crimped as shown, a cord 35 is threaded through the tube 32. The cord 35, having a diameter functions to ensure the maintenance of an open passageway within the tube in the deflated position; and thus prevents total closing of the tube 32 at the return bends 32C, which could prevent inflation of the tube when the solenoid valve is actuated.

When the wrap 30 is secured to the body part as shown in FIG. 5, the operation is similar to that hereinbefore described. With the air compressor operating and the solenoid valve 21 actuated to its inflating position, fluid pressure is directed by means of conduit 33 to the lowermost section of the inflatable tube 32 causing it to inflate. Each section of the zigzag pattern is thereafter successively inflated to impart to the adjacent body part a continuous, wave-like massaging pressure. Positive inflation of each section is assured by the cord 35 threaded thereto. After the last section of the zigzag pattern has been inflated, the timer causes the solenoid valve 21 to shift to its exhaust mode, whereby the fluid pressure within tube 32 is exhausted through the solenoid valve to atmosphere to effect deflation of the tube 32. Thereafter, the cycle is repeated and continued as long as desirable. In this form of the invention, there is a continuous wave-like massaging pressure applied to the body part to enhance circulation and/or to apply a soothing massage on the body part.

If desired, the circuit can be readily connected to a pair of shells or wraps, whereby one of the shells or wrap can be applied, to each leg or arm of a person and be alternately actuated. That is, as one shell is applying a massaging effect to one leg, the other shell is being deflated so that each leg is provided with an alternating body massage pressure.

The tubes are formed of a thin flexible, expandable material which functions as a balloon when inflated to impart a pressure on the body part, and whereby the pressure on the body part is released when the tube is deflated.

From the foregoing, it will be apparent that a relatively simple and positive pressure applying or massaging device is provided for imparting a wave-like pressure on the body part which enhances circulation.

FIGS. 7 to 11 illustrate a further embodiment of the invention. In this form of the invention, the arrangement is such that a massaging effect can be applied to two body parts, e.g. both legs of a patient, in a manner in which one leg is massaged when the massaging effect is relieved on the other leg or body part in an alternating manner. Also in this embodiment, the massaging effect, when applied to one body part, is imparted thereto in a progressive or wave-like motion, while the release of the massaging effect on the other body part is simultaneously, i.e. the entire massaging pressure on the body part is released instantaneously over the entire body part.

Figure 7:
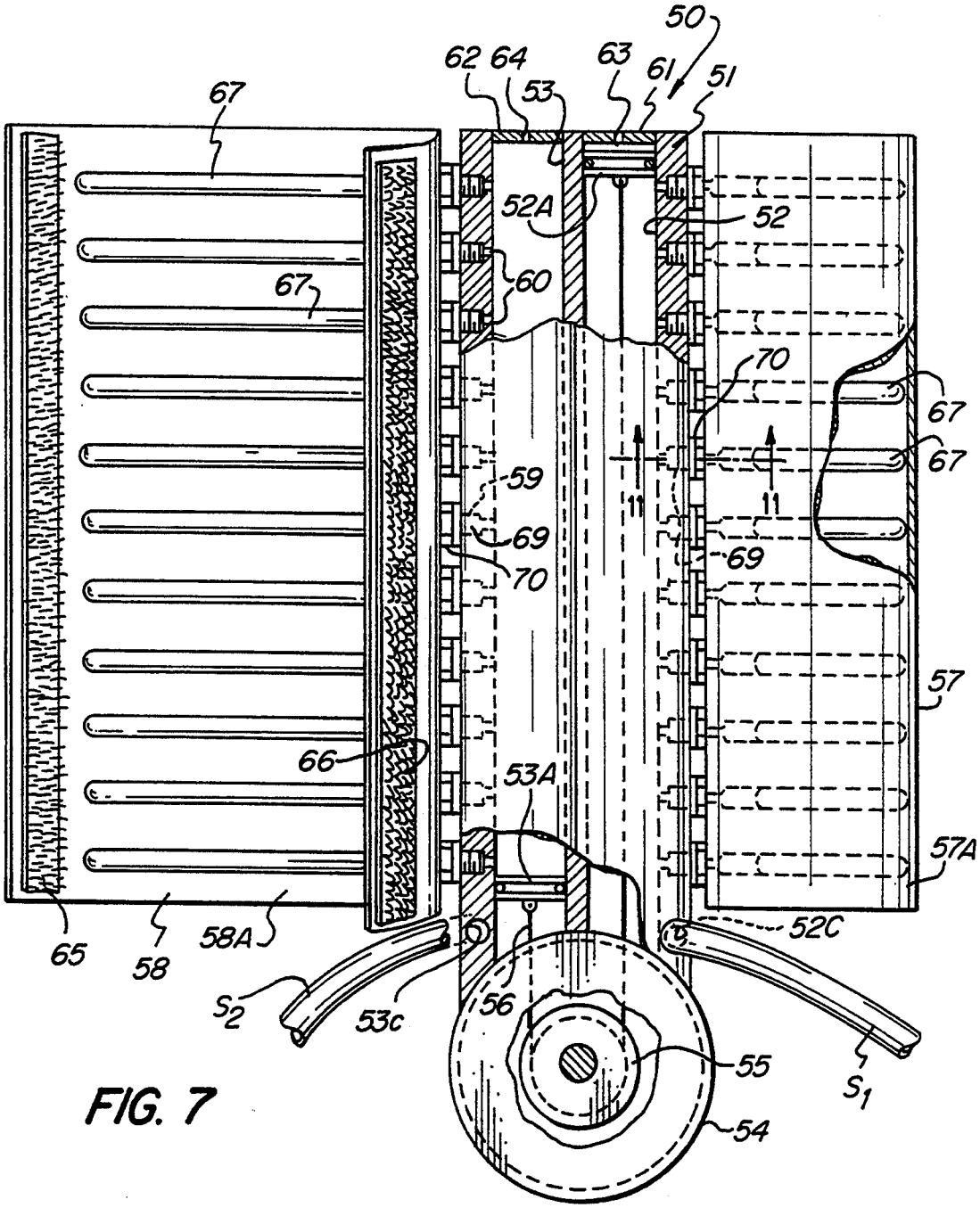
FIG. 7 is a side elevation view of another form of the invention.
Figure 8:
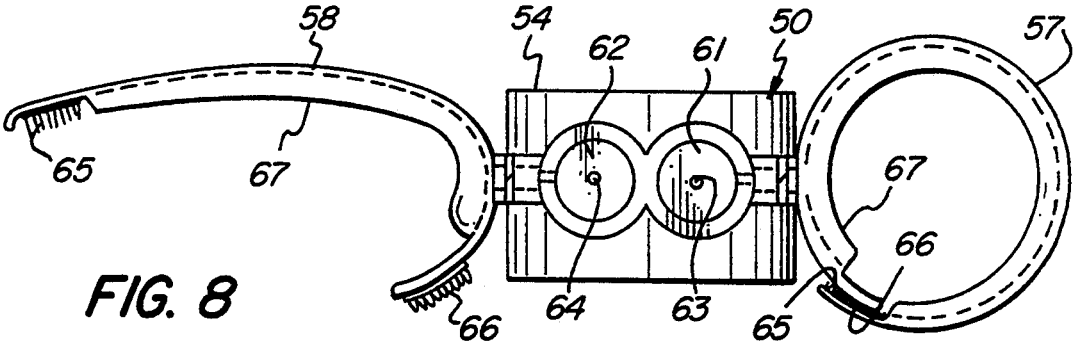
FIG. 8 is a top view of FIG. 7.
Figure 10:
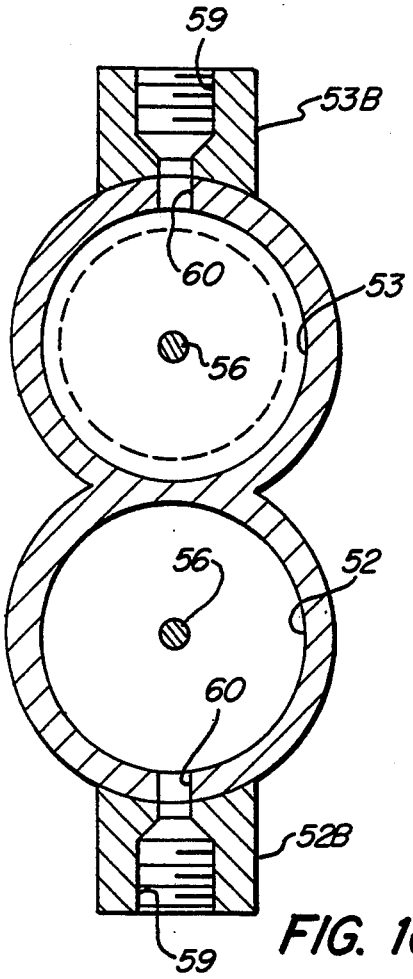
FIG. 10 is a detail sectional view taken along line 9—9 on FIG. 7.

As shown in FIGS. 7 and 8, the massaging appliance 50 comprises a supply manifold 51 which includes two independent cylinders 52 and 53. In the illustrated embodiment, the cylinders 52 and 53 are juxtadisposed in side by side relationship. A piston 52A and 53A is reciprocally disposed in cylinders 52 and 53 respectively. The cylinders 52 and 53 are connected to a base or housing 54 which has rotatably mounted therein a pulley 55. In this form of the invention, the respective pistons 52A and 53A are connected by a flexible cord or cable 56 which is threaded about pulley 55, the opposed ends of the cord or cable 56 being connected to the respective pistons 52A, 53A.

Connected to the outerside of each cylinder 52, 53 is a mounting bar or fixture 52B, 53B to which the sleeves or wraps 57 and 58 are attached, as will be hereinafter described. The respective mounting bars 52B, 53B are preferably formed of a rigid plastic in which a series of tapped holes 59 are formed at spaced apart intervals and in communication with the associated cylinder. The tapped holes 59 are disposed in alignment with a series of holes 60 spaced longitudinally along the length of the respective cylinders 52, 53. Disposed at the bottom of each cylinder mounting bar is a fluid inlet 52C, 53C disposed in communication with its corresponding cylinder 52, 53. It will be understood that a suitable supply conduit $S_1$, $S_2$ is adapted to be detachably connected to each of the fluid inlets 52C, 53C. The tops of the respective cylinders are closed by an end wall 61, 62, each of which is provided with a venting port 63, 64.

In this form of the invention, the respective wraps or sleeves 57, 58 are similarly constructed. Each wrap 57, 58 comprises a flexible sheet material 57A, 58A which is adapted to be folded about a body part to be massaged, e.g. a leg. The longitudinal edges of the wrap 57, 58 are provided with complimentary fastening means, e.g. the hook and loop type material commonly referred to as "Velcro." Such fastening strips are shown at 65, 66. In FIGS. 7 and 8, wrap 58 is shown in its open or inoperative position; and wrap or sleeve 57 is shown in its operative position.

Figure 11:
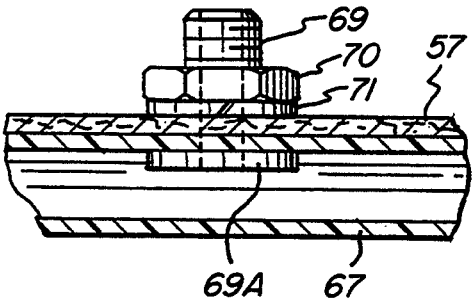
FIG. 11 is a sectional view of a detail of construction taken along line 10—10 on FIG. 7.
Figure 9:
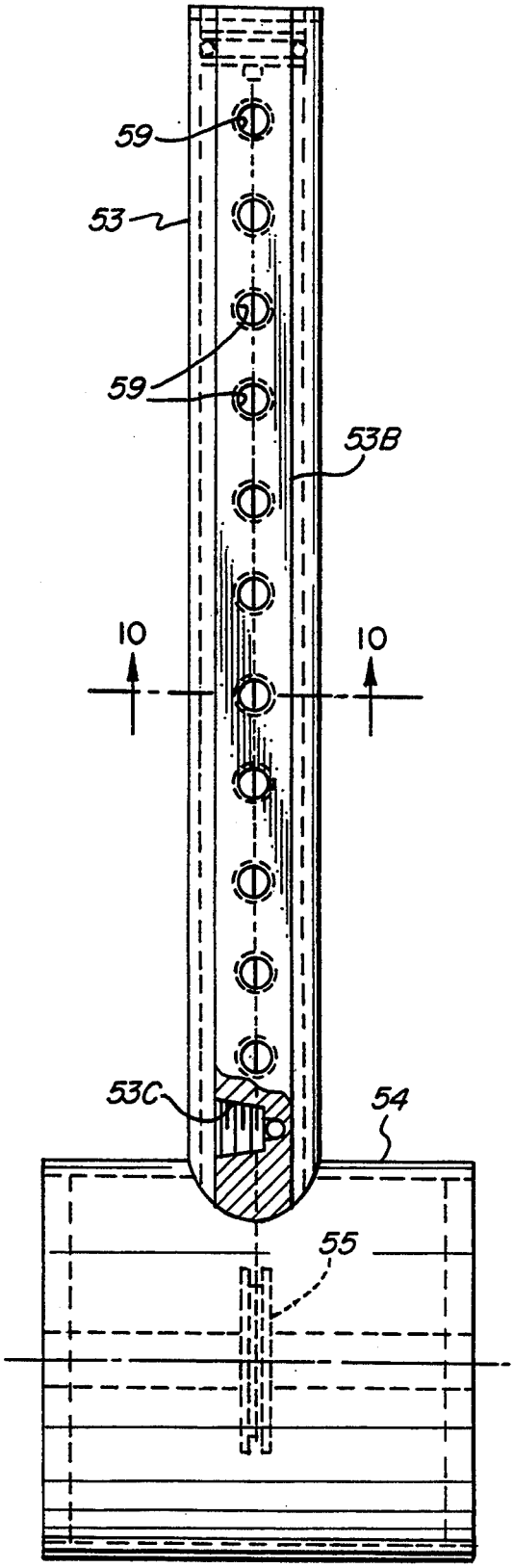
FIG. 9 is an end elevation view of the supply manifold.

Connected to the internal surface of the respective wraps or sleeves 57, 58 are a plurality of spaced apart inflatable tubes 67. The inflatable tubes 67 are horizontally disposed and are arranged to encircle the body part to be massaged in the operative position of the respective wrap. The respective inflatable tubes are in the form of an elongated tube or balloon having the fluid inlet disposed intermediate the opposed ends thereof. Referring to FIG. 11, the fluid inlet to each of the respective inflatable tubes comprises a stem 69 having a flange 69A arranged to be disposed within the inflatable tube with the stem 69 projecting outwardly of the inflatable tube. The exposed end of the stem is threaded. Threaded onto the stem 69 is a lock nut 70 for securing the stem to the balloon or tube 69. To perfect the seal between the stem 69 and the inflatable tube, a sealing washer 71 is interposed between the nut 70 and the inflatable tube 67. The outer end of the stem is threaded into the tapped hole 59 of the corresponding mounting bar. Thus, it will be apparent that each inflatable tube 67 is disposed in communication with the associated cylinder 52, 53 respectively. With the appropriate fluid lines $S_1$, $S_2$ connected to each of the respective cylinders 52, 53, the operation of the apparatus is as follows.

Wraps 57, 58 are wrapped and secured about the two body parts to be massaged, e.g. the legs of a patient. Referring to FIG. 7, when a pressure fluid, e.g. compressed air, is introduced into inlet 53C of cylinder 53, the air forces the piston 53A upwardly, causing the respective inlets to each of the inflatable tubes of wrap 58 to be progressively inflated. In doing so, a wave-like massaging effect is imparted to the body part enclosed by wrap 58. As the piston 53A rises, any air in the cylinder above piston 53A is vented through port 64. As piston 53A rises to successively inflate the inflatable tubes 67, the piston 52A in cylinder 52 is lowered, as piston 52A is interconnected to piston 53A by the connecting cord 56. Thus, one piston is always the slave to the other. As piston 52A lowers in respect to the rising of piston 53A, all the inflatable tubes 67 of wrap 57 are simultaneously deflated. Thus, as the tubes 67 of wrap 58 are being progressively inflated, the tubes 67 of the other wrap 57 are simultaneously deflated. This is effected by the fluid pressure in tubes 67 of wrap 57 being exhausted through port 63 and port 52C. It will be understood that the inlet 52C, 53C of the respective cylinders are connected to an exhaust valve 77 which is actuated to an open position by control valve 78 when either piston is moving in the exhaust stroke or direction. Through an appropriate timing and control circuit, the respective wraps 57 and 58 are alternately actuated, i.e. when one wrap is inflating, the other is exhausting, and the cycle being repeated in an alternating sequence.

Figure 12:
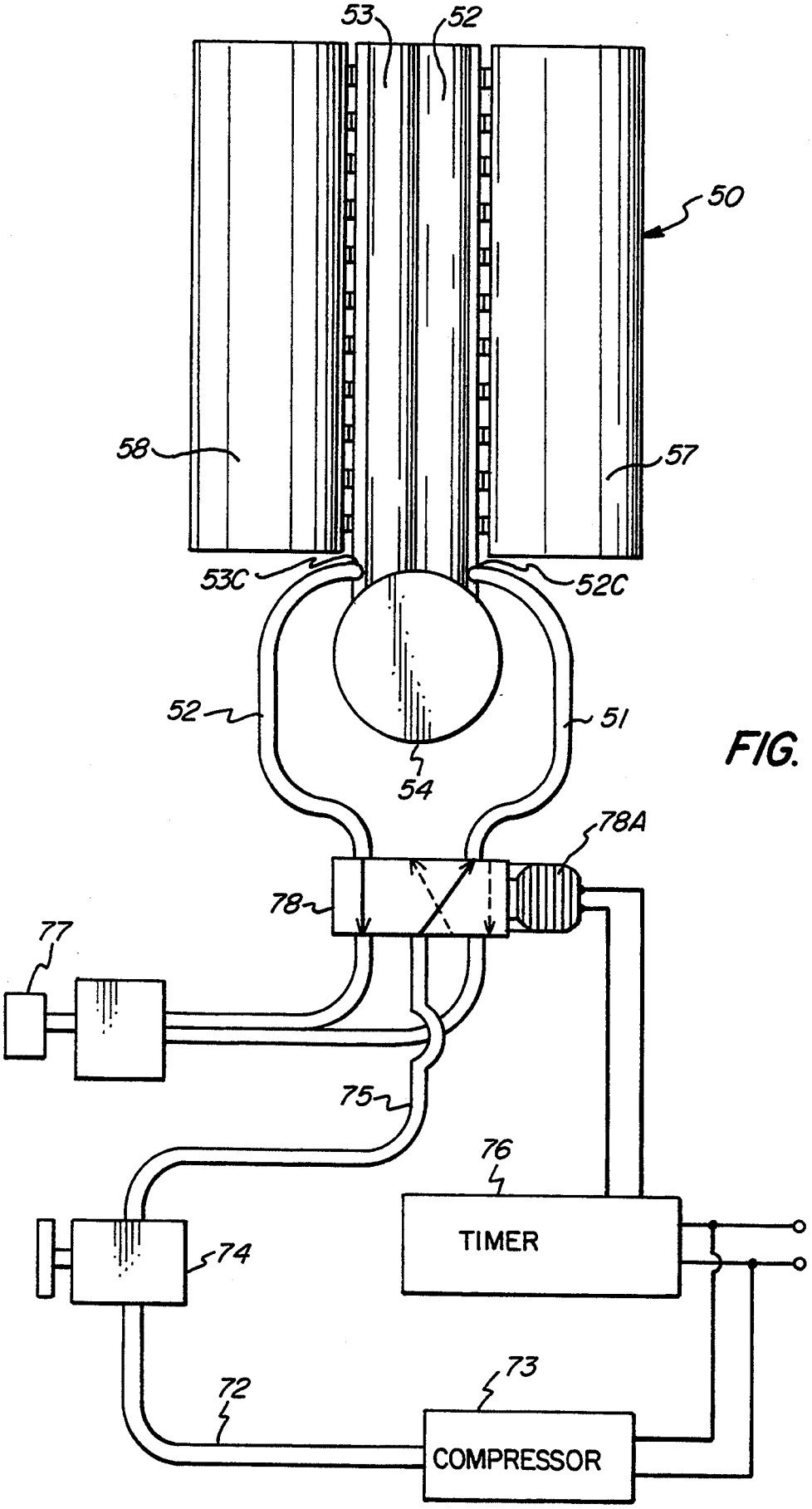
FIG. 12 is a schematic control diagram for operating the embodiment of FIGS. 6 to 11.

It will be understood that the inflation and deflation is automatically accomplished by the control circuit diametrically disclosed in FIG. 12. As shown, the outlet 72 of a fluid source, e.g. an air compressor 73, is connected through a suitable pressure regulator 74 by conduit 75 to the inlet of a control valve 78. Operatively connected to the control valve 78 is a suitable timer 76 to control the sequencing of the valve in a predetermined timed sequence. When the control valve 78 is actuated by a solenoid 78A to a first position to inflate the tubes of wrap 57, the control valve 78 is shifted to a first position to connect a supply line 75 into communication with supply conduit $S_1$ connected between the outlet of the control valve 78 and the inlet to cylinder 52. At the same time, the control valve 78 places cylinder 53 in an exhaust mode connecting chamber 53 to conduit $S_2$ to deflate wrap 58 through the exhaust valve 77. After the massaging stroke of wrap 57 has been complete, the control valve 78 is shifted to a second position in the opposite direction (to the left as seen in FIG. 12 by the broken line position) to connect supply line $S_1$ in communication with the exhaust means 77 and placing the supply conduit 75 in communication with supply line $S_2$ to effect the inflation of wrap 58 and the deflation of wrap 57. Accordingly, the cycle is repeated for a predetermined amount of time as may be required by the needs of a particular patient.

While the invention has been described with respect to particular embodiments thereof, it will be appreciated and understood that variations and modifications may be made without departing from the spirit and scope of the invention.

What is claimed is:

1. A massaging appliance for alternately massaging two body parts comprising a supply manifold including a pair of cylinders, a piston reciprocally mounted in each of said cylinders, means interconnecting said pistons whereby one of said pistons follows the other of said pistons in a predetermined manner, a pair of wraps, a plurality of spaced apart inflatable tubes adapted to circumscribe a body part to be massaged connected to each of said wraps, means connecting each of said inflatable tubes of each of said wraps to its corresponding cylinder, means for introducing an actuating fluid into each of said cylinders for sequencing said piston therein in an alternating manner whereby the piston in one of said cylinders successively inflates the inflatable tubes of one of said pair of wraps connected thereto to impart a progressive massaging action on a body part as the inflatable tubes of the other of said wrap connected to the other of said cylinders are simultaneously deflated to release the massaging effect on the other body part, a housing, said pair of cylinders being connected to said housing, a pulley mounted in said housing, and said interconnecting means being threaded about said pulley, and having opposed ends connected to each of said pistons.

2. A massaging appliance as defined in claim 1 wherein said interconnecting means connecting said pistons is a flexible cord.

3. A massaging appliance as defined in claim 1 and including an end wall closing the end of each of said cylinders, and a vent opening formed in each of said end walls.

4. A massaging appliance as defined in claim 1 and including a control circuit for alternately actuating said cylinders, said control circuit including a source of fluid pressure, and a control valve, said valve having a first position for directing fluid pressure to one of said cylinders for inflating the inflatable tubes of the associated wrap as the fluid pressure in the other cylinder is being exhausted to effect deflation of the inflatable tubes of said other wrap; and a second position for alternating the cycle.

5. A massaging appliance as defined in claim 4 and including a timer for timing the actuation of said control valve between said first and second positions.

6. A massaging appliance comprising a supply manifold including a pair of juxtapositioned cylinders, a housing connected to one end of said pair of cylinders, an end wall closing the other end of each of said pair of cylinders, a vent opening disposed in each of said end walls, inlet means connected to each of said pair of cylinders for introducing thereinto an actuating fluid pressure, a piston reciprocally mounted in each of said cylinders, a pulley mounted on said housing, a flexible connector threaded about said pulley, said flexible connector having its opposed ends connected to each of said pistons whereby one of said pistons follows the other of said pistons, a mounting bar connected to each of said cylinders and extending longitudinally thereof, a plurality of spaced apart holes formed in each of said mounting bars disposed in communication with its corresponding cylinder, a wrap connected to each of said mounting bars, each of said wraps including a sheet of flexible material adapted to be wrapped about a body part to be treated, means for securing each of said wraps in its operative position about a corresponding body part, a plurality of inflatable tubes connected to each of said wraps, means for connecting each of said inflatable tubes in communication with a corresponding hole of said mounting bar to dispose said inflatable tubes in communication with its corresponding cylinder, means connected to each of said inlet means for alternately introducing and exhausting fluid pressure into and out of said cylinders for progressively imparting a massaging force on one of said wraps, as the other is being simultaneously relieved of the massaging force.

7. A massaging appliance as defined in claim 6 and including a control means for alternating the inflation and deflation of the inflatable tubes of the respective wraps in a timed sequence, said control means including a source of fluid pressure, a control valve, means connecting said source of fluid pressure to said control valve, an exhaust valve connected to said control valve, and means for timing the actuation of said control valve between a first and second position, said control valve in said first position directing pressurizing fluid to one of said cylinders for progressively inflating said inflatable tubes connected to its associated wrap while directing the fluid in the other cylinder to said exhaust valve to effect the deflation of the inflatable tubes in the other wrap, and said control valve in its second position reversing the said direction of fluid pressure to and from said cylinders.

* * * * *